343-909 SR
11/14/78 OR 4,125,841

United States Patent [19]
Munk

[11] 4,125,841
[45] Nov. 14, 1978

[54] SPACE FILTER

[75] Inventor: Benedikt A. Munk, Columbus, Ohio

[73] Assignee: Ohio State University Research Foundation, Columbus, Ohio

[21] Appl. No.: 797,798

[22] Filed: May 17, 1977

[51] Int. Cl.² ..... H01R 15/10
[52] U.S. Cl. ..... 343/909; 343/872
[58] Field of Search ..... 343/909, 781 CA, 781 P, 343/779, 831, 872, 18 A, 18 B

[56] References Cited

U.S. PATENT DOCUMENTS 2,747,184 5/1956 Kock ..... 343/909
3,295,131 12/1966 Hollingsworth ..... 343/909
3,754,271 8/1973 Epis ..... 343/909

*Primary Examiner*—Alfred E. Smith
*Assistant Examiner*—David K. Moore
*Attorney, Agent, or Firm*—Sidney W. Millard

[57] ABSTRACT

An improved space-filter formed as a composite multi-layered structure. Utilizing a periodic slot array structure nested between first and last strata of a dielectric material, the filter exhibits a constant bandwidth characteristic over a broad range of angles of incident radiation. Where two slot arrays are utilized in parallel relationship, an intermediate dielectric layer is provided which has an effective dielectric function selected to achieve critical array component coupling.

17 Claims, 18 Drawing Figures

SPACE FILTER

The invention described herein was made in the course of work done under a contract from the United States Air Force.

BACKGROUND

Investigators have expended considerable effort in the study of surfaces in space which are selectively passive to the transmission of electromagnetic energy. Such studies have evolved a broad spectra of designs for a considerable variety of transmission and reception applications. For example, the aerospace industry has a continuing interest in improved radome structures capable of performance under rigorous high-speed all-weather aircraft applications. Conventionally structured radomes formed of rigid dielectric or ceramic materials have evidenced a broad range of operational problems. Precipitation noise encountered at high speed and occasioned by static charge buildup and subsequent discharge to the airframe has represented a hindrance to the performance of enclosed equipment. As requirements for scan angle flexibility have enlarged, a variety of effects are encountered. For instance, a transmission loss and phase distortion are witnessed. Further, the equipment enclosed by more conventional radomes is susceptible to lightning damage as well as to thermal problems developed by poorly controlled frictionally induced skin heating.

Over the somewhat recent past, investigations of scattering from periodic arrays of slots and their performance as band-filters of electromagnetic radiation has suggested the application thereof, inter alia, as metallic radomes. Metallic radomes provide such advantages as the elimination of precipitation noise, inherent lightning protection; improved shielding against spurrious low frequency pulses due to the above-noted band-pass filter characteristics; and a potentially improved mechanical strength for the radomes. However, due to aerodynamic design constraints, the geometric shapes which these radomes must assume, for example ogival or conical, have developed a need to accommodate scan angles of incidence of values of 80° and above. Without correction, scanning over such geometry will engender a lack of pass bandwidth constancy in dependence upon the asserted E- and H-plane angles of incidence.

Developments seeking to cure certain of these deficiencies of the metallic radomes include the utilization of arrays of resonant short dipole elements of length less than one half wave length which are loaded by a slot structured in the manner of a two-wire transmission line, as described in U.S. Pat. No. 3,789,404. As another approach to improving the noted deficiencies, reactively loaded periodic tripole slot elements have been developed as are described in U.S. Pat. No. 3,975,738. However, these design approaches have, for the most part, failed to meet the very rigid criteria of maintaining operational stability even though incident scan angles reach values of 80° and above.

The same design approaches as discussed above for metallic radomes also have been utilized to develop a space filter for use as a low loss dichroic plate permitting a simultaneous single antenna transmission of both X and S band energy. In this regard, mention may be made of U.S. Pat. No. 3,769,623.

A broadened utility for space filters of the type described requires performance over a relatively broadened band pass region of interest with lowered transmission loss within that region. Such performance is characterized by transmission curves which exhibit a flatness in the region of interest at unity transmission coefficient and relatively sharp skirts. To the present, such performance has represented an elusive goal, particularly where the noted relatively high scan angles of incidence are contemplated.

Those artskilled in the investigation of scattering from periodic arrays will recognize that the theory applied in connection with periodic arrays of recurring slots are directly applicable to periodic arrays of dipoles. In terms of circuit concepts, periodic arrays of dipoles are band-stop, or reflection filters. Within their operating band, properly designed arrays of dipoles reflect incident signals in a manner comparable to a highly-conductive solid metal surface. Outside of this reflection, however, incident signals pass through the array dipoles. Periodic arrays of slots, on the other hand, perform a complementary role, with respect to dipole arrays. Slot arrays function as an electromagnetic window within their operating bands or passbands permitting incident electromagnetic signals to pass through the array. Outside of this operating band the array becomes opaque, reflecting the incident signal.

SUMMARY

The present invention is addressed to an improved space filter, an important utility of which resides in its use as a radome structure. Basically formed as a composite, relatively thin multilayered structure, the filter incorporates at least one periodic array of filter components, for example, a resonant slotted conducting layer or surface, in combination with layers or strata of dielectric material, one being disposed in adjacency with each oppositely disposed surface of the periodic array, or slotted layer. Thus configured, the composite structure exhibits a stable or constant pass bandwidth characteristic over electromagnetic radiation angles of incidence as high as 80° and above for both the E- and H-planes. While achieving this desired performance, the composite structure of the invention enjoys all of the advantageous attributes for radome application as are realized with slotted metallic arrays.

Another object and feature of the invention is to provide a compensated space filter formed as a composite multi-layered structure including at least two spaced parallel resonant slotted conductive sheets, a coupling dielectric layer disposed intermediate the conductive layers as well as exteriorly disposed dielectric strata positioned adjacent the surfaces of the conductive sheets opposite the surfaces thereof facing the intermediately disposed coupling dielectric material. This filter arrangement advantageously evolves highly desired bandfilter characteristics evidencing a transmission coefficient curve exhibiting low loss at the bandwidth extent of interest for angles of incidence up to 80° and above in both the E-plane and the H-plane. Of additional importance the layer structuring described provides for the advantageous achievement of a stable or constant bandwidth as a function of the noted broad range of incidence angles.

A further object of the invention is to provide a composite space filter for use in conjunction with electromagnetic radiation which incorporates at least two conductive surfaces, each carrying a periodic array of slots and being spaced apart a predetermined distance, $d_1$. Intermediate these surfaces or sheets is a dielectric material or the equivalent thereof serving a coupling function and exhibiting an effective dielectric constant $\epsilon_1$. Outwardly disposed of the conductive sheets are first and last strata of dielectric material respectively having thicknesses $d_2$ and $d_3$ and effective dielectric constants $\epsilon_2$ and $\epsilon_3$ for effecting a substantially constant frequency bandwidth pass characteristic over a broad range of angles of incidence of electromagnetic radiation.

The distance, $d_1$, and dielectric constant, $\epsilon_1$, are arranged to provide a coupling, Q, with each periodic array of slots. Additionally, the distance $d_2$, $d_3$ and respective dielectric constants $\epsilon_2$ and $\epsilon_3$ are selected having values providing a conductance $GA^G(0)$ with respect to each array. The coupling, Q, and conductance, $GA^G(0)$ are derived having values in substantial satisfaction of the expression:

$$1 = \frac{1}{2}\left[\frac{G_A^G(0)}{Q} + \frac{Q}{G_A^G(0)}\right]$$

Another feature and object of the invention is to provide a multilayer space filter structure comprising a plurality of conductive sheets each configured having a periodic array of slots. Dielectric layers are positioned intermediate adjacent pairs of these conductive sheets and have thicknesses and exhibit effective dielectric constants for carrying out a coupling of the periodic arrays. Additionally, first and last dielectric strata are respectivey situated adjacent to outermost disposed ones of the conductive sheets and have thicknesses and exhibit effective dielectric constant for deriving a conductance for developing a constant bandwidth characteristic for the space filter.

It will be understood that, while the preferred embodiment of the invention is described in connection with the theory of periodic arrays of slots, the theory, as discussed above, is applicable to periodic arrays of dipoles to achieve a bandstop or reflection filter function.

Other objects of the invention will, in part, be obvious and will, in part, appear hereinafter.

The invention, accordingly, comprises the apparatus possessing the construction, combination of elements and arrangement of parts which are exemplified in the following detailed disclosure. For a fuller understanding of the nature and objects of the invention, reference should be had to the following detailed description taken in connection with the accompanying drawings.

DETAILED DESCRIPTION

The features of the present invention and discoveries attendant with its developement are best described in conjunction with the theory of its performance. Accordingly, in the discourse to follow, the undesirable band width alteration affects occcasioned utilizing periodic slot arrays are discussed, following which a general description of correction available through the provisions of outboard "first and last" strata of dielectric material is set forth. Following the above general discourse, the utilization of conductive sheet slot arrays in tandem, i.e. in spaced parallel adjacency and resultant transmittance and bandwidth irregularities are disclosed. As the description further unfolds, a space filter compensated to achieve desired transmission and constant band-pass characteristics initially is disclosed schematically along with theory of performance, commencing with the noted tandem slotted arrays and ending with the theory of their coupling in accordance with the invention.

Figure 1:
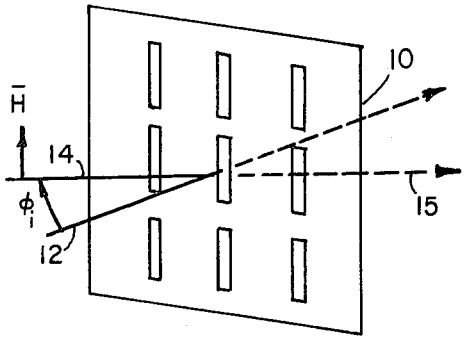
FIG. 1 is a shematic representation of a slot array also showing plane wave vectors and resultant transmission through the array.

Looking now to FIG. 1, a somewhat schematic portrayal of a conductive surface 10 incorporating a periodic slot array is revealed. An axis perpendicular to the surface 10 is shown at 12, while a plane wave is represented by a vector 14 as being incident upon the surface 10 at an angle $\phi_i$ measured in the E-plane. The transmission of this wave is represented as vector 15.

Figure 2:
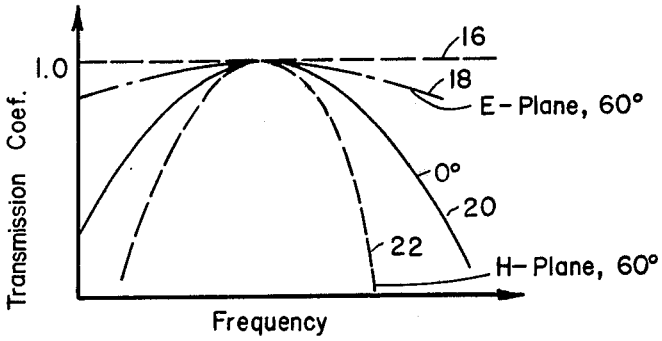
FIG. 2 is a family of transmission curves showing idealized transmission characteristics for various angles of incidence in the E-plane and H-plane.

FIG. 2 is an idealized representation of the alteration of band-pass width which occurs with varying angles of incidence in both the E-plane and H-plane for an elementary slot array, as revealed in FIG. 1. Dashed line 16 represents the level of ideal transmission, i.e. at a transmission coefficient of 1.0. Curve 18 represents the transmission characteristic for an incident plane wave in the E-plane at a 60° angle of incidence, while curve 20 represents transmission with respect to frequency for a zero angle of incidence, and curve 22 represents the transmission characteristic of an incident plane wave measured in the H-plane at an angle of 60°. While curves 18–20 do meet at a common point of resonance at unity transmission, the transmission curves additionally are observed to considerably vary the band-pass frequency for variations in incidence angle. Note, that the band-pass region generally is measured at about the 70% level of such curve and at that level there is no constancy in this value with respect to plane wave angles of incidence. Such inconsistency in the region of bandwidth interest is considered to detract from the practicality of space filters.

The effect of screen thickness on a single slotted surface as at 10 has been investigated, it having been shown that the effect of such increase in thickness is to make the resonance range more narrow. For more detailed discourse concerning the latter, reference is made to the following publications;

I. Luebbers, R. J. and B. A. Munk, "Rectangular Arrays of Resonant Slots in Thick Metallic Panels with Finite Conductivity," Report 2989-4, August 1972, The Ohio State University Engineering; prepared under Contract F33615-70-C-1439for Air Force Avionics Laboratory, Wright-Patterson Air Force Base, Ohio. (AD 902936L) (AFAL-TR-72-237)

II. Luebbers, R. J. and B. A. Munk, "Analysis of Thick Rectangular Waveguide Windows with Finite Conductivity," IEEE Trans. on Microwave Theory and Techniques, Vol. MTT-21, No. 7, July 1973, pp. 461–468.

Figure 3:
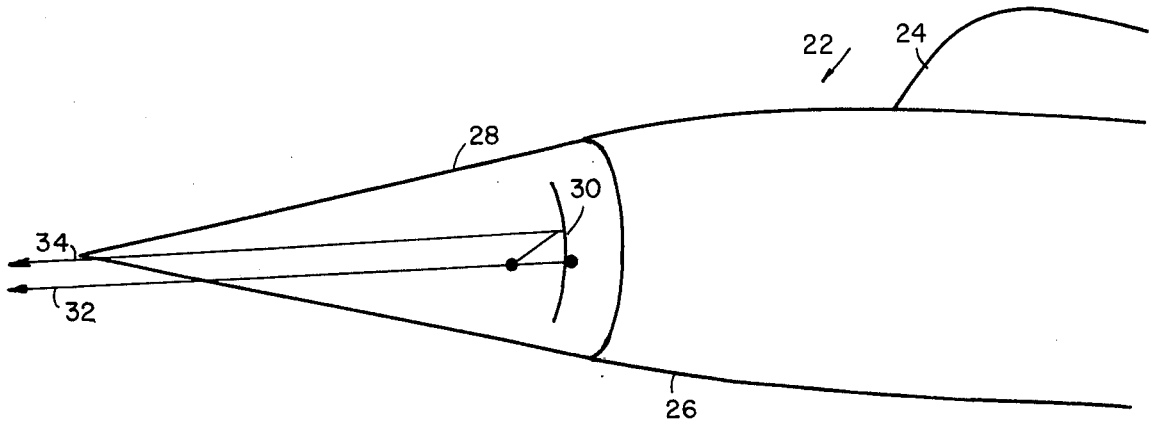
FIG. 3 is a schematic representation of a random affixed to the nose of a high performance aircraft.

The utilitarian aspect of requisite performance over a range of angles of incidence is revealed in a practical application illustrated schematically in connection with FIG. 3. In the figure, the profile of a typical high performance aircraft is revealed generally at 22. This profile shows a cockpit arrangement 24, main fuselage or airframe 26 and a conically structured radome 28. Schematically portrayed within radome 28 is a dish antenna shown as transmitting, for example, along vectors identified at 32 and 34. It will be apparent from the diagram that, by manipulation of antenna 30, angles of incidence, as measured to lines or planes perpendicular to a given point of interception of the inward surface of radome 28, will vary considerably. Additionally, for practical utility, the radar equipment should be capable of operation at angles of incidence at values, for example, of 80° and above.

Figure 4:
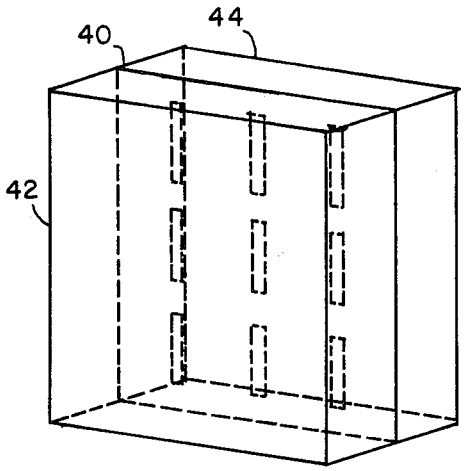
FIG. 4 is a schematic representation of a space filter representing one aspect of the invention.

Looking now to FIG. 4, one aspect of the invention is portrayed in general and simplified fashion. Here, the surface carrying a slot array is revealed at 40 positioned intermediate to outboard strata 42 and 44 which are configured to provide an equivalent dielectric constant selected for achieving a constant frequency bandwidth pass characteristic over a given range of angles of incidence of impinging radiation. This desired constant frequency bandwidth characteristic is revealed in the idealized transmission curves of FIG. 5. Here, it may be seen that all of the curves described in connection with FIG. 2, i.e. a 60° angle of incidence in the E-plane, a 60° angle of incidence in the H-plane and a 0° angle of incidence, are congruent with curve 46. As in the latter figure, the curves intersect at a position of maximum transmission, the point of intersection of curve 46 with dashed line 48.

Figure 5:
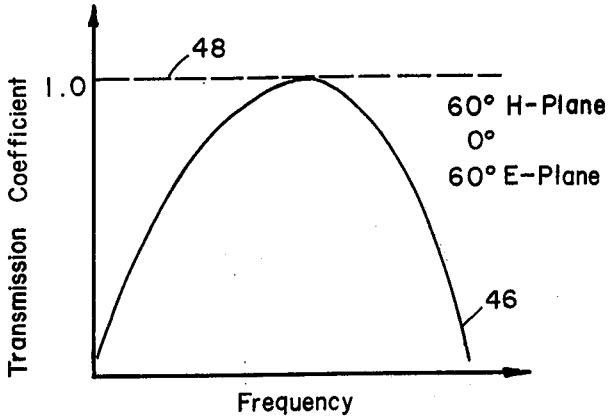
FIG. 5 is an idealized transmission curve for the space filter embodiment of FIG. 4.

As is apparent from curves 46 in FIG. 5, the structure of FIG. 4 provides only a point or very narrow value at the more desired unity transmission coefficient for the band-pass width sought for space filter utilization. Investigators in the past have reported that the reflection characteristics from an arbitrary number of layers of resonant dipoles can provide band filter characteristics having a broader range or band availability in the region of interest defined by a unity transmission coefficient. In this regard, reference is made to the following publications:

III. Munk, B. A., R. J. Luebbers, and R. D. Fulton, "Transmission Through a Two-layer Array of Loaded Slots," IEEE Trans. on Ant. and Prop., Vol. AP-22, No. 6, November 1974,pp. 804–809.

IV. Luebbers, R. J. and B. A. Munk, "Reflection from N-Layer Dipole Array," Report 2989-12, July 1973, The Ohio State University Electro-Science Laboratory, Department of Electrical Engineering; prepared under Contract F33615-90-C-1439 for Air Force Avionics Laboratory, Wright-Patterson Air Force Base, Ohio (AD 912993L) (AFAL-TR-73-256)

V. Munk, B. A., R. J. Luebbers, "Reflection Properties of Two-layer Dipole Arrays" IEEE Trans. on Ant. and Prop., Vol. AP-22, No. 6, November 1974, pp. 766–773.

Figure 6:
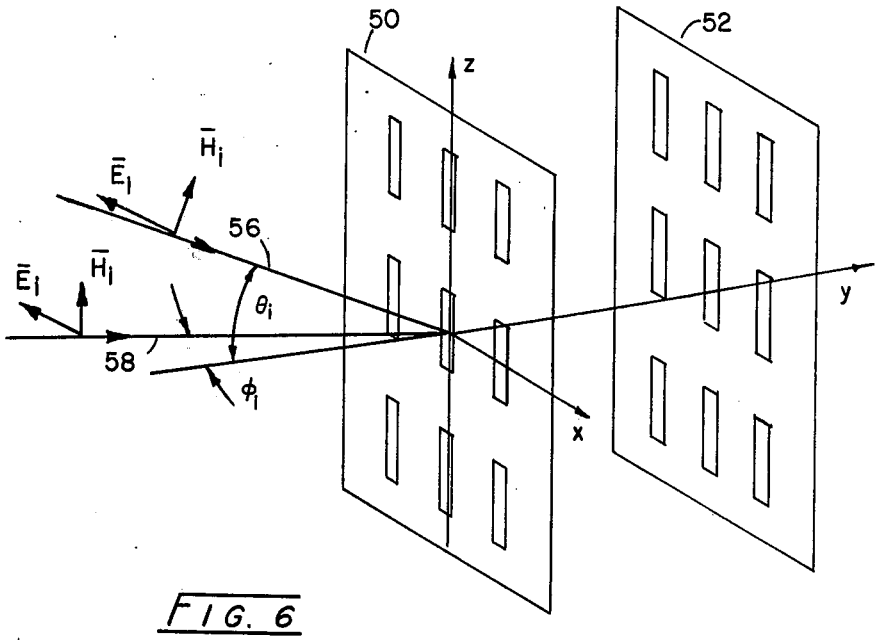
FIG. 6 is a schematic representation of two conductive surfaces carrying periodic arrays of slots.
Figure 7:
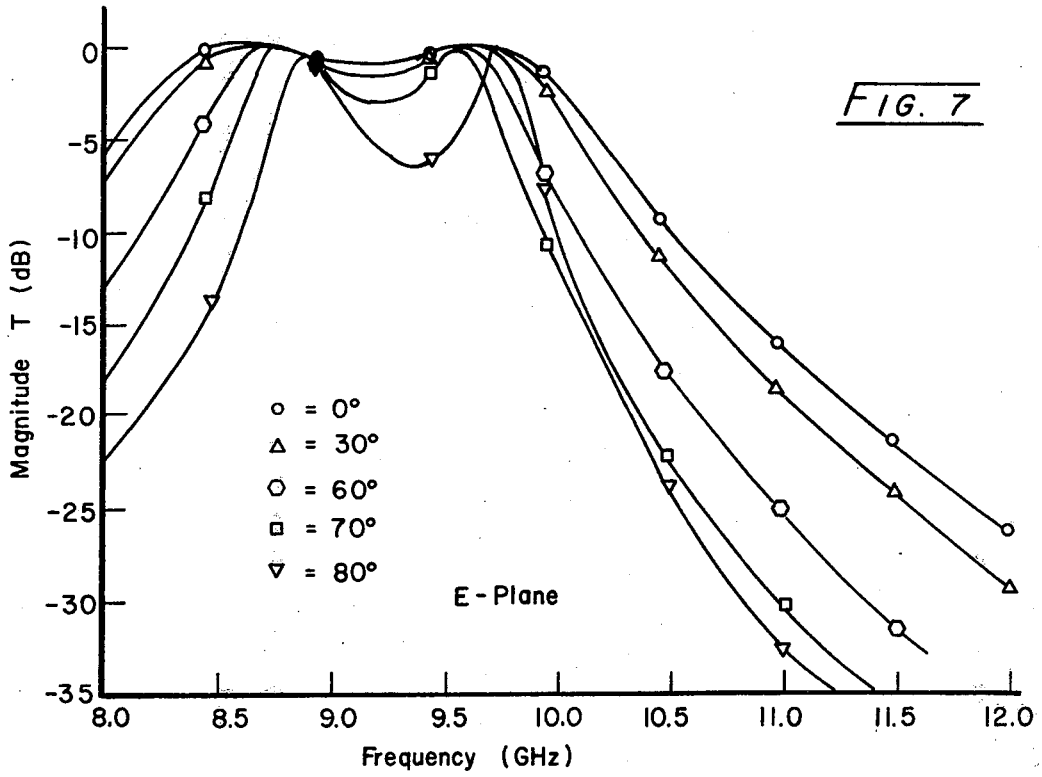
FIG. 7 is a family of transmission curves taken in the E-plane utilizing a pair of spaced cross-shaped slot arrays.
Figure 8:
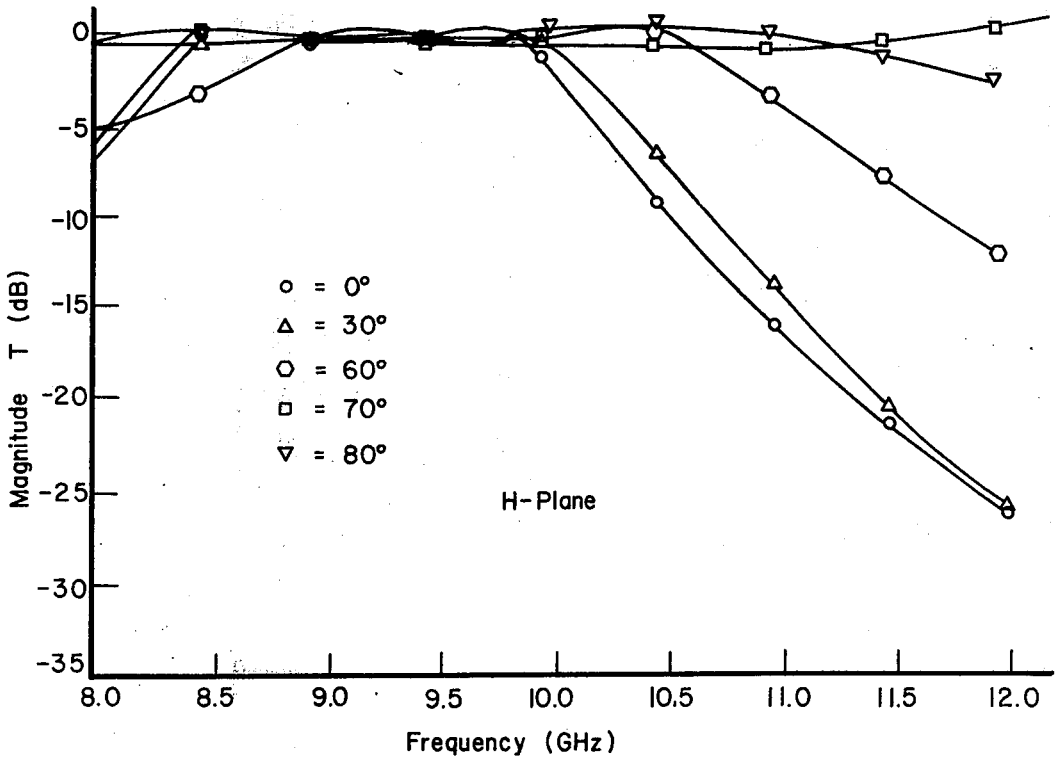
FIG. 8 is a family of transmission curves for the H-plane corresponding with the curves of FIG. 7.
Figure 9:
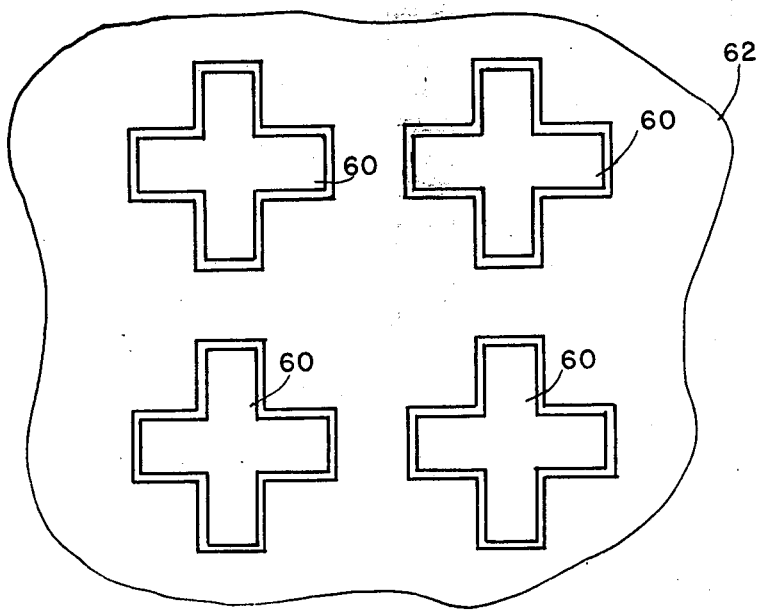
FIG. 9 is an enlarged drawing of slot configurations utilized in generating the transmission curves shown in later figures.

A generalized portrayal of such a configuration is provided in connection with FIG. 6. In the figure, a conductive surface 50 incorporating an array of slots is shown spaced from an identical corresponding surface 52 incorporating a similar array of slots, $x$, $y$ and $z$ designated axes additionally are provided in the representation in combination with two plane wave vectors 56 and 58. These vectors, respectively, are shown at angles of incidence $\phi_i$ in the E-plane and $\phi_i$ in the H-plane. While broadened transmission curve widths in the above-noted region of interest are available with such a configuration, the arrangement suffers two principal disadvantages: a changing bandwidth with angle of incidence, and a characteristic loss of transmission within the bandwidth region of interest. Concerning the former, as the incident angle, $\phi$, varies for example from 0° through 80°, the bandwidth correspondingly varies in a proportion of approximately $1{:}\cos^2\phi$ of the incident angle. For an incident angle of 80°, this ratio becomes 1:33, an entirely unacceptable variation. These deficiencies are revealed in connection with FIGS. 7 and 8, wherein transmission curves for spaced parallel slot arrays over a range of angles of incidence, respectively, in the E-plane and H-plane are plotted. Generated with arrays utilizing the slot structure shown in FIG. 9, the curves reveal that, while better selectivity may be recognized with the structural arrangement shown in FIG. 6, and, while the curves evidence desirably sharper skirts, the transmission loss in the region of interest at higher angles of incidence is excessive, as is evident in FIG. 7.

Returning to FIG. 9 it may be observed that the slot configuration is one wherein each slot is formed as a cross having an internal conductive portion 60 which is positioned intermediate each slot and the surrounding conductive media 62. Both the horizontal and vertical components of the slot structures are correspondingly mutually aligned to provide a regular periodic array.

The transmission property for two such slot arrays which are positioned on each opposed surface of a slab of dielectric material have been studied. In this regard, reference is made to the following publication:

VI. Munk, B. A., R. J. Luebbers, and R. D. Fulton, "Transmission Properties of Bi-Planar Loaded Slot Arrays," Report 2989-10, March 1973, The Ohio State University ElectroScience Laboratory, Department of Electrical Engineering; prepared under Contract F33615-70-C-1439 for Air Force Avionics Laboratory, Wright-Patterson Air Force Base, Ohio. (AD 909359L) (AFAL-TR-73-103)

However, the above described difficulties at higher angles of incidence, for example in the slot H-plane continue to exist.

Figure 10:
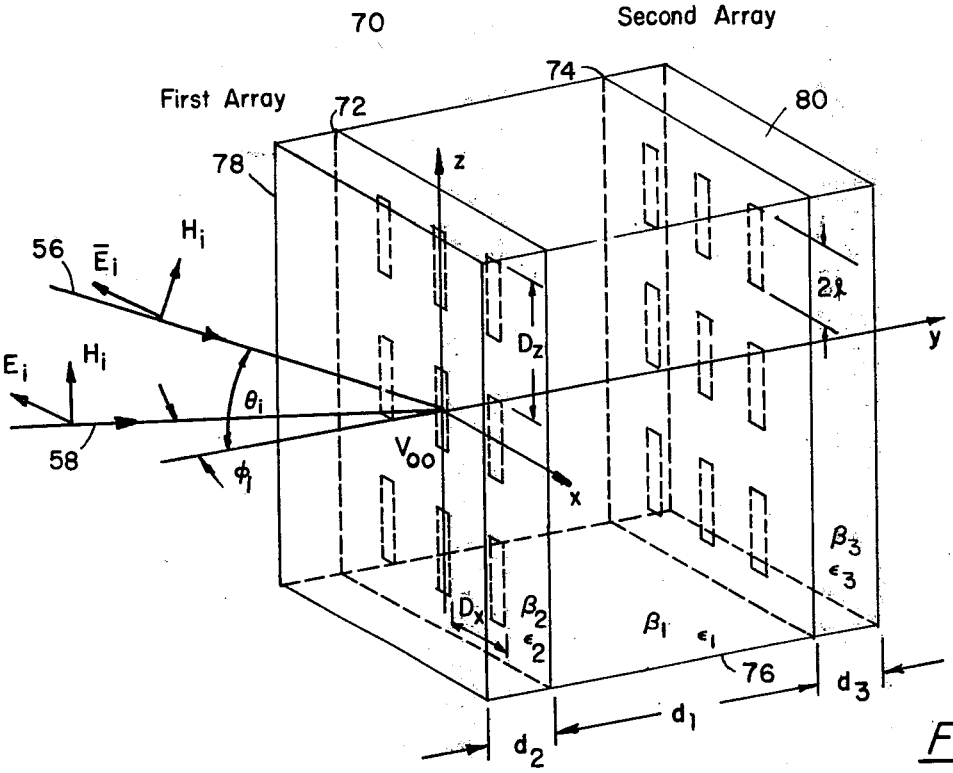
FIG. 10 is a schematic representation of a space filter formed in accordance with the invention.

Solution to the foregoing difficulties is provided with the instant invention which, in the interest of clarity, is described in conjunction with the schematic portrayal provided in connection with FIG. 10. In the figure, a 5-layer symmetrical configuration for a space filter is provided. This structure, revealed generally at 70, includes two conductive sheets 72 and 74 which are arranged in mutually parallel and spaced symmetry and incorporate corresponding slot arrays which, for the instant demonstration, are shown as elementary slots and which are arranged in alignment across the *x*, *y* and *z* axes shown. Sheets 72 and 74 are spaced apart for the above-discussed frequency bandwidth region of interest determination, and within that intermediate space is positioned a slab of dielectric material of thickness represented in the drawing as $d_1$. The drawing further reveals that slab 76 is provided having an equivalent relative dielectric constant $\epsilon_1$ and plane wave propagation constant, $\beta_1$. The term "relative" dielectric constant is considered that taken with respect to the dielectric constant value of air. The drawing further reveals the presence of first and last outwardly disposed strata of dielectric material, respectively represented at 78 and 80. Dielectric strata 78 is shown having a thickness $d_2$, propagation constant, $\beta_2$, and a relative dielectric constant $\epsilon_2$, the above thickness being measured along the *y* axis. Note that for analysis purposes, sheet 72 is located in the xz-plane. Further, for purposes of description, dielectric strate 78 is referred to as the "first" stratum. In symmetrical fashion, dielectric stratum 80 is shown having a thickness $d_3$, propagation constant, $\beta_3$ and a relative dielectric constant $\epsilon_3$.

Looking specifically to the slot arrays within sheets 72 and 74, each array is considered to contain (2R + 1) rows and (2K + 1) columns of slots each of length $2l$ and with interelement spacings $D_x$ and $D_z$.

In the analysis of the structure of FIG. 10 to follow, a calculation of induced voltages initially is provided, following whcih a calculation of transmitted field is evolved for structural configurations as at FIG. 10. To further facilitate the description to follow, the slot array within conductive sheet 72 will be referred to as the "first array," while the slot array within conductive sheet 74 will be referred to as the "second array." The slots in the first and second arrays may be considered to be loaded with load admittances $Y_{l1}$ and $Y_{l2}$, respectively; a plane wave is considered to be incident upon the configuration of FIG. 10 at an angle $\phi_i$ measured from the negative *y*-axis in the XY-plane (E-plane or $\phi$-plane) or at an angle $\theta_i$ measured from the negative *y*-axis in the YZ-plane (H-plane or $\phi$-plane). The field transmitted through this configuration now may be determined as follows:

A vector effective height of a given reference slot, designated under convention as No. 00, in the first array may be represented by the expression: $\bar{h}_s^D(\theta_i)$.

The reduced current in this reference element is then $\bar{h}_s^D(\theta_i)$. $\bar{H}_i$, where $\bar{H}_i$ is the magnetic field vector of the incident field. Since the second array is shielded from the incident field by the first array, no current will be directly induced in the second array due to the incident field. Referring to Publication III above for enhanced definition, considering the mutual admittance between slots, the following two equations for the reference slots in the first and second arrays respectively may be developed:

$$\bar{h}_s^D(\theta_i) \cdot \bar{H}_i = (Y_{L1} + Y_A^G)\, V_{oo}^{(1)} + Y_{1,2}^T\, V_{oo}^{(2)} \tag{1}$$

$$0 = Y_{21}^T\, V_{oo}^{(1)} + (Y_{L2} + Y_A^G)\, V_{oo}^{(2)} \tag{2}$$

where: $Y_{nm}{}^T$ = mutual admittance sum between the reference element *oo* in an array *n* and all the elements in array *m*, i.e.

$$Y_{nm}^T = \sum_{r=-R}^{R} \sum_{k=-K}^{K} Y_{n,rk}^T\, e^{-j\phi} \tag{3}$$

$$Y_A^G = \sum_{r=-R}^{R} \sum_{k=-K}^{K} Y_{o,rk}^G\, e^{-j\phi} \tag{4}$$

where $$\phi = \begin{cases} \beta D_x\, r \sin\phi_i & \text{for } \phi\text{-plane scan} \\ \beta D_z\, k \sin\theta_i & \text{for } \theta\text{-plane scan} \end{cases} \tag{5}$$

and further $V_{rk}{}^{(n)}$ denotes the terminal voltage across element *rk* in array *n*, where because of Floquet's theorem $$V_{rk}^{(n)} = V_{oo}^{(n)}\, e^{-j\phi}. \tag{6}$$

The mutual admittance sum $Y_{12}{}^T$ and the admittance sum of a single slot array with dielectric strata and backed by a ground plane (the superscript G) has been derived and discussed in detail in the following publication:

VII. Munk, B. A., R. C. Fulton and R. J. Luebbers, "Plane Wave Expansion for Arrays of Dipoles or Slots in Presence of Dielectric Slabs," Report 3622-6, The Ohio State University ElectroScience Laboratory, Department of Electrical Engineering; prepared under Contract F33615-73-C-1173 for Air Force Avionics Laboratory, Wright-Patterson Air Force Base, Ohio.

Equations (1) and (2) formally determine the unknown quantities $V_{oo}{}^{(1)}$ and $V_{oo}{}^{(2)}$. However, since the present interest is exclusively in the transmitted field determined entirely by the voltages $V_{rk}{}^{(2)}$ in the second array, only those voltages then are determined. From equations (1) and (2):

$$V_{00}^{(2)} = \bar{h}_s^D(\theta_i) \cdot \bar{H}_i \frac{Y_{21}^T}{[Y_A^G + Y_{L1}][Y_A^G + Y_{L2}] - Y_{12}^T Y_{21}^T} \tag{7}$$

After having determined the voltage $V_{oo}{}^{(2)}$ by Equation (7) above, it is now a simple matter to find the transmitted field. Which is determined to be $$H^{F.S.} = j\frac{N\,V_{oo}^{(2)}}{\pi Z_o} F_{E3,H3}\left[F_{e1} - \frac{Y_{L2}}{Y_A} F_{e2}\right] p_s^D(\theta_i) \frac{e^{-j\beta(r_o - d_2\left\{\begin{matrix}\cos\phi_i\\ \cos\theta_i\end{matrix}\right\})}}{r_o} \tag{8}$$

$N = (2R + 1)(2K + 1)$ = Total number of elements in a dipole array. (9)

$F_{E3,H3}$ is described in publication III above.

$p_s^D(\theta_i)$ = the element pattern of the individual element under receiving (scattering) condition, and $$F_{e1} = \frac{\sin\beta l - \beta l \sin\beta l_e}{1 - \cos\beta l_e} \tag{10}$$

$$F_{e2} = \frac{1}{2\cos\beta l_e}\,[1 - \cos\beta l_e - F_{e1}\sin\beta l_e]. \tag{11}$$

For a more detailed discussion of equation (8) reference is made to the following publication:

VIII. Munk, B. A. and R. J. Luebbers, "Transmission Properties of Dielectric Coated Slot Arrays," Report 2989-8, February 1973, The Ohio State University Electro-Science Laboratory, Department of Electrical Engineering; prepared under Contract F33615-70-C-1439 for Air Force Avionics Laboratory, Wright-Patterson Air Force Base, Ohio. (AD 907628L) (AFAL-TR-73-26)

The transmission coefficient for the above biplanar, dielectric strata-slot condiguration is now defined as the ratio between $H^{F.S.}$ as given by Equation (8) above and field $H_{Eq.Op.}$ transmitted through the "Equivalent Opening" defined as an aperture with the area:

$$A = (2R + 1)(2K + 1)\,D_xD_z = N\,D_xD_z. \tag{12}$$

Referring again to publication VIII above, for such an aperture located in the XZ-plane, the transmitted field may be expressed as $$H_{Eq.\,Op.} = j\frac{A\,H_i}{\lambda}\,\frac{e^{-j\beta r_o}}{r_o}\cos\left\{\begin{matrix}\phi_i\\ \theta_i\end{matrix}\right\} \tag{13}$$

Thus for the transmission coefficient, T, it may be determined by division of Equations (13) by (8):

$$1/T - \frac{H_{Eq.Op.}}{H^{F.S.}} = \frac{\beta Z_o\,A\,H_i\cos\left\{\begin{matrix}\phi_i\\ \theta_i\end{matrix}\right\} e^{-j\beta d_2\cos\left\{\begin{matrix}\phi_i\\ \theta_i\end{matrix}\right\}}}{2N\,V_{oo}^{(2)}\,F_{E3,H3}\left[F_{e1} - \frac{Y_{L2}}{Y_A}F_{e2}\right]p_s^D(\theta_i)} \tag{14}$$

Sustituting Equations (7) and (12) into Equation (14):

$$1/T = \frac{\beta Z_o\,D_x\,D_z\cos\left\{\begin{matrix}\phi_i\\ \theta_i\end{matrix}\right\} e^{-j\beta d_2\cos\left\{\begin{matrix}\phi_i\\ \theta_i\end{matrix}\right\}}}{2h_s^D(\theta_i)p_s^D(\theta_i)F_{E3,H3}\left[F_{e1} - \frac{Y_{L2}}{Y_A}F_{e2}\right]} \frac{[Y_{A1}^G + Y_{L1}][Y_{A3}^G + Y_{L2}] - Y_{12}^TY_{21}^T}{Y_{21}^T} \tag{15}$$

The vector effective height $\bar{h}_s^D(\theta_i)$ of a dielectric covered slot may be represented as:

$$\bar{h}_s^D(\theta_i) = -\hat{\theta}_i\frac{4}{\beta}F_{E1,H1}\frac{\cos\beta\Delta l - \cos\beta l_e}{\sin\beta l_e}\,p_t^D(\theta_i) \tag{16}$$

where $p_t^D(\theta_i)$ is the radiation pattern of the individual element under transmitting conditions, Substituting Equation (16) into Equation (15) yields $$1/T = \frac{\sqrt{K_1}\,\sqrt{K_2}}{F_{E1,H1}\,F_{E3,H3}}\,\frac{Z_o^2}{4}\,Y(d_{1,2,3};Y_{L1},Y_{L2}) \tag{17}$$

where $$\sqrt{K_1} = \frac{\pi(l/\lambda)^2}{60\left[\frac{\cos\beta\Delta l - \cos\beta l_e}{\sin\beta l_e}\right]\left[F_{e1} - \frac{Y_{L2}}{Y_A}F_{e2}\right]} \tag{18}$$

$$\sqrt{K_2} = \frac{D_x/l\,D_2/l\cos\left\{\begin{matrix}\phi_i\\ \theta_i\end{matrix}\right\}}{p_s^D(\theta_i)\,p_t^D(\theta_i)} \tag{19}$$

$$Y(d_{1,2,3};\,Y_{L1},Y_{L2}) = -\frac{[Y_{A1}^G + Y_{L1}]\,[Y_{A2}^G + Y_{L2}] - Y_{12}^TY_{21}^T}{Y_{21}^T}\,e^{-j\beta d_2\cos\left\{\begin{matrix}\phi_i\\ \theta_i\end{matrix}\right\}} \tag{20}$$

This expression can be further reduced to the fllowing expression:

$$\frac{Z_o^2}{4}\,\frac{\sqrt{K_1}\,\sqrt{K_2}}{F_{E1,H1}\,F_{E3,H3}} = \frac{1}{2\,G_{A1}^G(0)^{\frac{1}{2}}\,G_{A2}^G(0)^{\frac{1}{2}}} < -F_{E1,H1} < -F_{E3,H3}\,. \tag{21}$$

where $G_{Al}^G(0)$ and $G_{A2}^G(0)$ are defined below.

Substituting Equation 29 into Equation 17 yields the formula:

$$1/T = \frac{Y(d_{1,2,3};Y_{L1},Y_{L2})}{2\,G_{A1}^G(0)^{\frac{1}{2}}\,G_{A2}^G(0)^{\frac{1}{2}}} < -F_{E1,H1} < F_{E3,H3}\,. \tag{22}$$

The admittances in the expression for $Y(d_{1,2,3};Y_{L1},Y_{12})$ given by Equation 22 above have been described in publication VII above and are represented as follows:

$$Y_{A1}^G = \sum_n G_{A1}^G(n) + j\,B_{A1}^G \tag{23}$$

-continued $$Y^G_{A2} = \sum_n G^G_{A2}(n) + j B^G_{A2} \tag{24}$$

where $G_{Al}{}^G(n)$ = the conductance of a propagating mode of the first slot array coated with a dielectric stratum of thickness $d_1$ and dielectric constant $\epsilon_1$ and backed by a ground plane. In particular $n=0$ corresponds to the principal (desired) propagation, while other values of $n$ (if any) correspond to grating lobes.

$B_{A1}{}^G$ = the total susceptance of a slot array coated with a dielectric stratum of thickness $d_1$ and dielectric constant $\epsilon_1$ and backed by a ground plane at a distance $d_2$ and where the "cavity" is filled with a relative dielectric constant $\epsilon_1$ and backed by a ground plane at a distance $d_2$ and where the "cavity" is filled with a relative dielectric constant $\epsilon_2$.

$G_{A2}{}^G$ and $B_{A2}{}^G$ are defined in an anologous way for the second array. Note, however, that this array is coated with the dielectric $d_3$ ($\epsilon_3$).

Finally, the mutual admittances $Y_{12}{}^T$ and $Y_{21}{}^T$ have been deteremined to be entirely imaginary: $Y_{12}{}^T = j Q_{12}$. By substituting the latter expression and Equations 23 and 24 into Equation 22 we obtain:

$$1/T = \frac{[\sum_n G^G_{A1}(n)+j(B^G_{A1}+Y_{L1})]\,[\sum_n G^G_{A2}(n)+j(B^G_{A2}+Y_{L2})]+Q_{12}Q_{21}}{2j\,Q_{12}\sqrt{G^G_{A1}(0)G^G_{A2}(0)}} \tag{25}$$

$$e^{-j\beta d_2 \cos\begin{Bmatrix}\phi_i\\ \theta_i\end{Bmatrix}} < -F_{E1,H1} < -F_{E3,H3}.$$

Equation 25 may be greatly simplified. If the two arrays are identical, but $Y_{L1} \neq Y_{L2}$, it can be shown that a lossy transmission coefficient always is present. See publication VI above. If the two arrays as well as the load admittance $Y_{L1}$ and $Y_{L2}$ are different it is not definite that loss will always result.

Attention now is made to the Symmetric Case: $d_2=d_3$, $\epsilon_2=\epsilon_3$, $Y_{L1}=Y_{L2}$.

In this symmetric case Equation 25 above reduced to $$1/T = \frac{[\sum_n G^G_A(n) + j(B^G_A+Y_L)]^2 + Q^2}{2j\,Q\,G^G_A(0)}\, e^{-j\beta d_2 \cos\begin{Bmatrix}\phi_i\\ \theta_i\end{Bmatrix}} < -2F_{E1,H1} \tag{26}$$

In order to find the extrema of Equation 26, the following numerical value is found:

$$1/|T|^2 = \frac{1}{4G^G_A(0)^2Q^2}\,[B^4 + 2B^2([\Sigma G^G_A(n)]^2 - Q^2) + ([\Sigma G^G_A(n)]^2 + Q^2)^2] \tag{27}$$

where, for brevity, $$B = B_A{}^G + Y_L. \tag{28}$$

Inspection of Equation 27 shows that it contains three variables: B, $\Sigma G_A{}^G(n)$ and the coupling Q. Of these, the parameter B will vary by far the most as a function of frequency except when operating close to a grating lobe which will be investigated separately, Thus, in order to determine the extrema of $1/|T|^2$ given by Equation 27, it is considered permissible to differentiate with respect to B (provided Q and $G_A{}^G(n)$ vary slightly)

$$\frac{d[1/|T|^2]}{d\,B} = \frac{B}{G^2_A(0)Q^2}\,[B^2 + ([\Sigma G^G_A(n)]^2 - Q^2)] \tag{29}$$

which has the roots $$B_o/Q = 0 \tag{30}$$

and $$B_{\pm 1} = \pm Q\sqrt{1 - \frac{[\Sigma G^G_A(n)]^2}{Q^2}} \tag{31}$$

The transmission coefficients $T_o$ corresponding to the root $B_o$, and $T_{\pm 1}$, are obtained from Equation 27 as $$1/|T_o| = \frac{1}{2}\left[\frac{G^G_A(n)^2}{G^G_A(0)Q} + \frac{Q}{G^G_A(0)}\right] \tag{32}$$

and $$1/|T_{\pm 1}| = \frac{\Sigma G^G_A(n)}{G^G_A(0)} \tag{33}$$

Thus, from Equation 33 above we observe that a unit transmission coefficient can be obtained only at $T_{\pm 1}$ for $$G_A{}^G(0) = \Sigma G_A{}^G(n) \tag{34}$$

i.e., if no free space grating lobes exist. Apparently this condition is independent of the coupling Q. However, note that $B_{\pm 1}$ exists only for $Q \geqq \Sigma G_A{}^G(n)$.

Equation (34) is valid if no free space grating lobes exist, i.e. if the slots of the array are closely nested (less than one half wave length spacing). If Equation (34) is substituted into Equation (32) the following expression results:

$$\frac{1}{|T_o|} = \frac{1}{2}\left[\frac{G^G_A(0)}{Q} + \frac{Q}{G^G_A(0)}\right] \tag{35}$$

Ultimate design requires a unity transmission coefficient, i.e. $|T_o| + 1$. This will occur only if the ratio of conductance to coupling becomes unity, i.e. $G_A{}^G(0)/Q = 1$.

Figure 11:
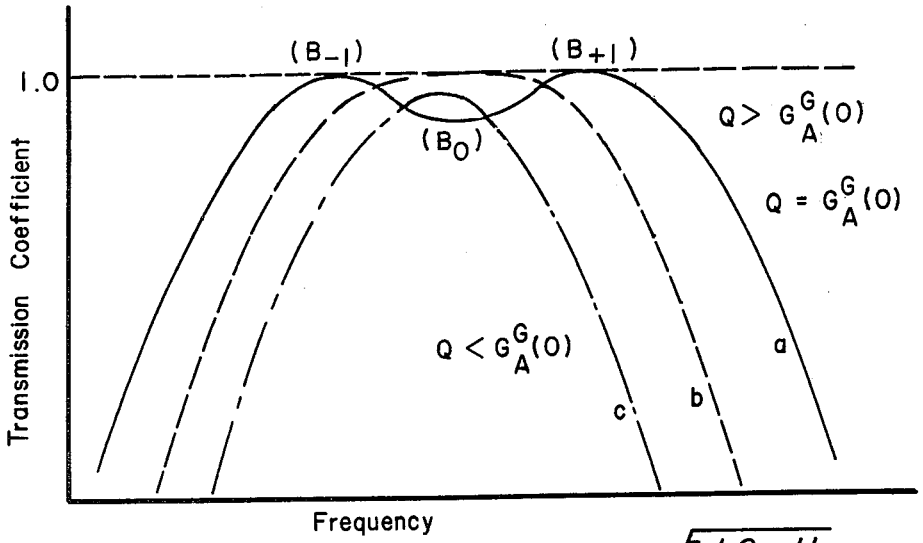
FIG. 11 is an idealized family of transmission or band-filter curves or two spaced slot arrays, the curve showing coupling effects.

A pictorial summary of the findings above is provided in FIG. 11. This figure reveals that there is obtained:

overcritical coupling with no loss at $B_{\pm 1}$ if
(a) no free space grating lobe,
(b) $Q > G_A{}^G(0)$;

critical Coupling with no loss at $B_{\pm 1} = B_o = 0$ if
(a) no free space grating lobes,
(b) $Q = G_A{}^G(0)$; and undercritical coupling with loss at $B_o = 0$ if
(a) $Q < G_A{}^G(0)$ From FIG. 11, the following may be summarized, a desired "critical" coupling may be achieved, as represented by curve *b* in the figure, i.e. a curve evidencing a flat top, where the following relationship holds: $Q/G_A{}^G(0) = 1$. An overcritical or stronger coupling is generated, as evidenced by curve a of the figure where: $Q/G_A^G(0) > 1$. Finally, an undercritical coupling is achieved as represented by curve *c* in FIG. 11 where the relationship $Q/G_A^G(0) < 1$.

By basing the selection of design parameters upon the foregoing discussion, a space filter may be derived exhibiting the desired coupling represented by curve *b* of FIG. 11, i.e. a flat top over the bandwidth region of interest at about the unity level of transmission coefficient, and evidencing sharp skirts beyond that region. Of course, tailoring of the transmission characteristic to other performance criteria also can be accomplished through the utilization of the instant teachings. The ideal transmission curve characteristic may be sought by selecting the first strata 78 and last strate 80 for conductance $G_A^G(0)$, and intermediate dielectric slab 76 for coupling, Q, to achieve a unity ratio thereof as described above. The above-noted tailoring for a different characteristic phenomena may be achieved through selection in the overcritical and undercritical criteria.

Figure 18:
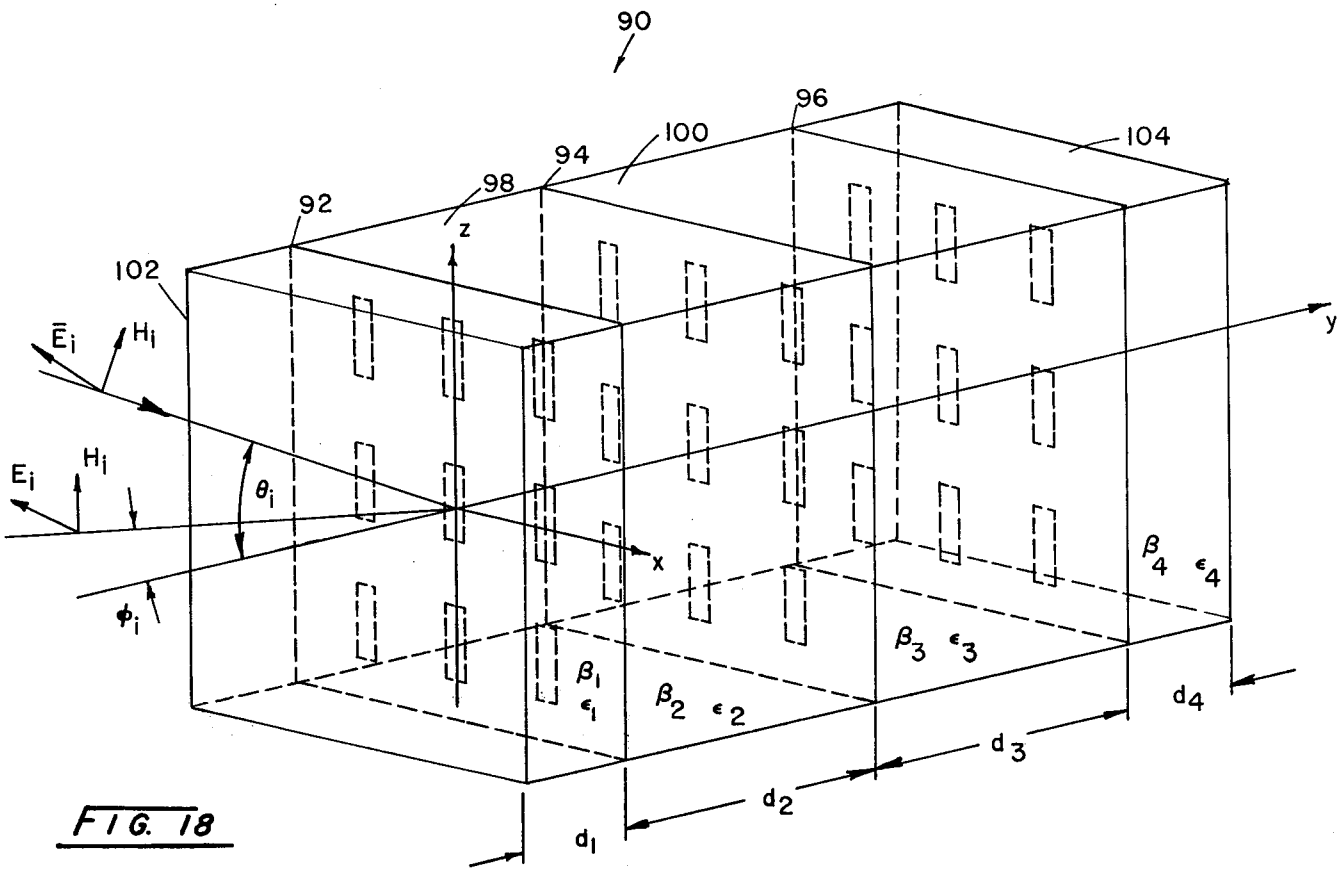
FIG. 18 is another schematic representation of a space filter formed in accordance with the invention.

The numbers of layers incorporated within the space filter may be varied to suit the particular requirements of the designer. FIG. 18 reveals a seven-layer symmetrical configuration for a space filter. This structure, revealed generally at 90, includes three conductive sheets 92, 94 and 96 which are arranged in mutually parallel and spaced symmetry and incorporate corresponding slot arrays which, for the purpose of demonstration, are shown as elementary slots. These are arranged in alignment across the *x*, *y* and *z* axes illustrated. Sheets 92 and 94 are shown spaced apart by a slab of dielectric material 98 of thickness represented in the drawing as $d_2$. The drawing further reveals that slab 98 is provided having an equivalent relative dielectric constant $\epsilon_2$ and a plane wave propagation constant $\beta_2$. As before, the term "relative" dielectric constant is considered that taken with respect to the dielectric constant value of air. In similar fashion, sheets 94 and 96 are spaced apart by a slab of dielectric material 100 having a thickness represented in the drawing as $d_3$. As before, slab 100 is provided having an equivalent relative dielectric constant $\epsilon_3$ and plane wave propagation constant, $\beta_3$. The drawing further reveals the presence of first and last outwardly disposed strata of dielectric material, respectively represented at 102 and 104. Dielectric strata 102 is shown having thickness $d_1$ and propagation constant, $\beta_1$ and a relative dielectric constant, $\epsilon_1$, the above thickness being measured along the *y* axis. In symmetrical fashion, dielectric stratum 104 is shown having a thickness $d_4$, a propagation constant, $\beta_4$, and a relative dielectric constant $\epsilon_4$.

The *x*, *y* and *z* designated axes in the figure are provided in conjunction with two plane wave vectors, 106 and 108. These vectors, respectively, are shown at angles of incidence $\phi_i$ in the E-plane and $\theta_i$ in the H-plane. As described hereinbelow, the design approach to multilayer structures is substantially the same as the approach described in connection with the earlier discussed figures. For example, the parameters described in connection with dielectric slabs 98 and 100 are selected with respect to critical coupling, requirements of frequency bandwidth being considered. In identical fashion to the earlier embodiments, the parameters of the other dielectric strata 102 and 104 are selected with respect to conductance considerations to achieve a constancy of bandwidth response with wide variation of scan angle.

Figure 12:
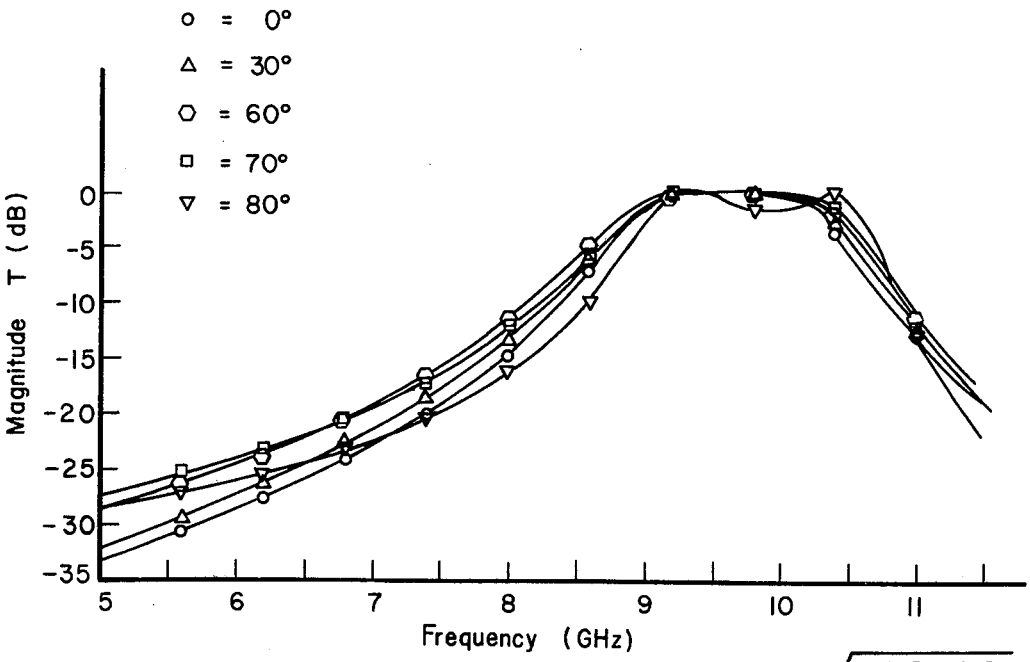
FIG. 12 shows a family of calculated transmission curves as a function of frequency for various angles of incidence taken in the E-plane.
Figure 13:
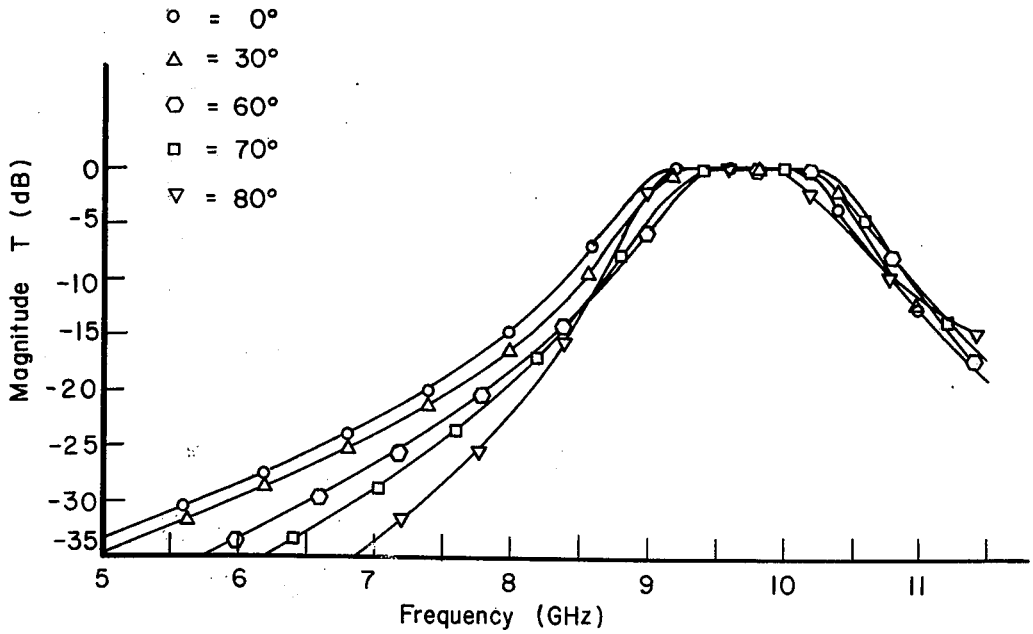
FIG. 13 is a family of calculated transmission curves as a function of frequency for various angles of incidence taken in the H-plane.

To generally demonstrate a design approach, reference is made to FIGS. 12 and 13. FIG. 12 looks to the conductance criteria at the outer strata and provides families of curves for varying angles of incidence with respect to normalized conductance and the electrical thickness $d_2/\lambda_2$ of the outer strata. As indicated, normalization is achieved by the generation of the value: $G_A^G(0)/G_A^G(0)_{fr\ sp}$. Complementing the family of curves in FIG. 12, are a similar, incident angle related curve families in FIG. 13. FIG. 13 shows the normalized coupling, Q, as a function of the electrical thickness $d_1/\lambda_1$ of the centrally disposed dielectric slab 76. A unity transmission design simply is provided by choosing appropriate values from curves 12 and 13 to generate a unity transmission ratio in compliance with the expression of Equation (83). Further with regard to design, it may be observed that the thickness of the dielectric strata as well as the intermediate slab as well as the relative dielectric constant of material used for them provide an important flexiblity in achieving design performance criteria. Typical values for relative dielectric constant that will be found in developing structures approaching a constant bandwidth at the frequency region of interest and evidincing unity transmission coefficient will fall within a range of about 1.2 to 1.8. Additionally, the total thickness for the structure wil be found to be an odd multiplum of slightly more than a one quarter wave length, i.e. $\frac{1}{4}$, $\frac{3}{4}$, 5/4, etc.

Figure 14:
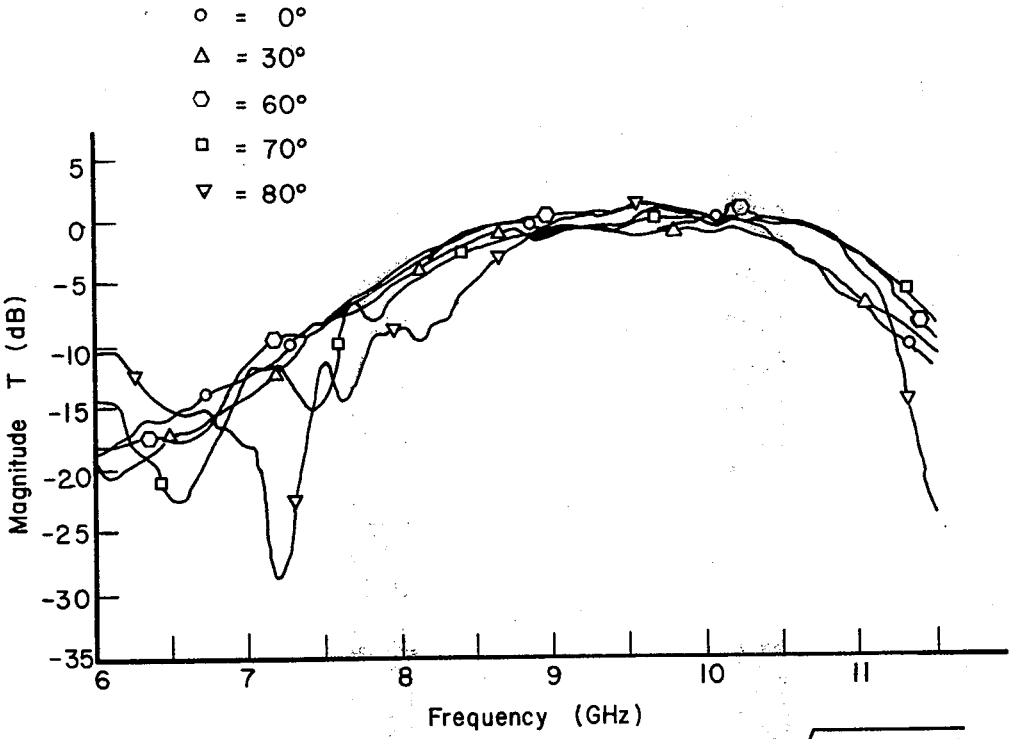
FIG. 14 is a family of measured transmission curves as a function of incidence angle taken in the E-plane.
Figure 15:
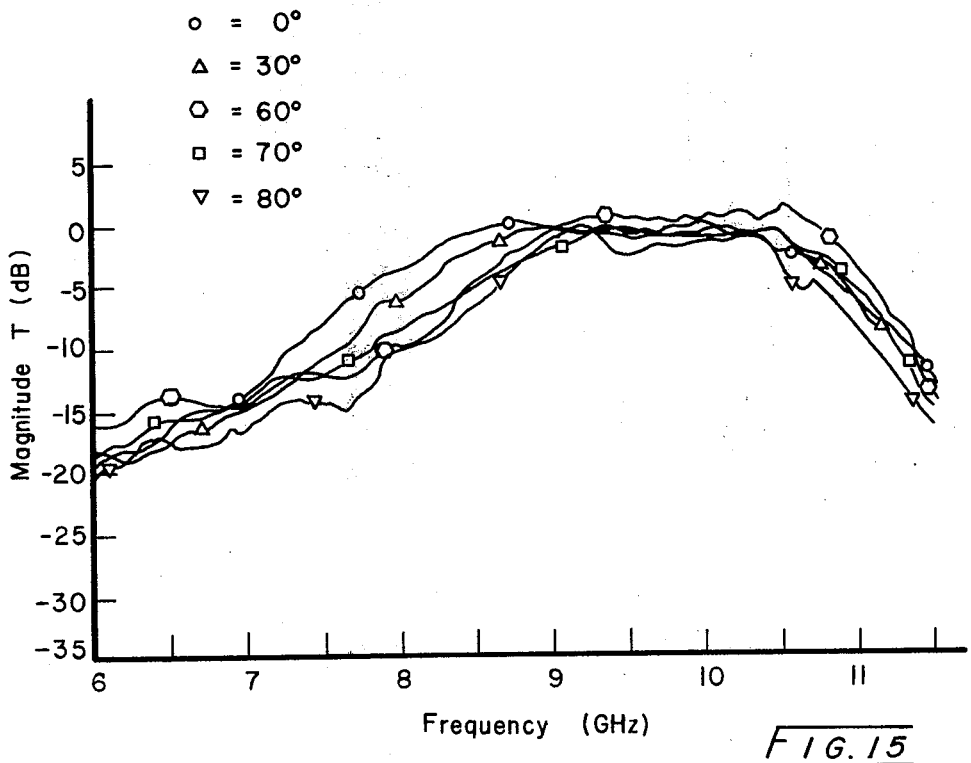
FIG.15 is a family of measured transmission curves as a function of various angles of incidence taken in the H-plane.

Now looking to FIGS. 14 and 15, a set of calculated transmission curves for a typical design in the frequency range 5–18 $GH_z$ for a broad range of angles of incidence is revealed. Of the curves, FIG. 14 represents E-plane performance, while FIG. 15 represents performance in the H-plane. Note that band-width remains substantially constant with angles of incidence ranging up to 80° for both of the principal planes.

Figure 17:
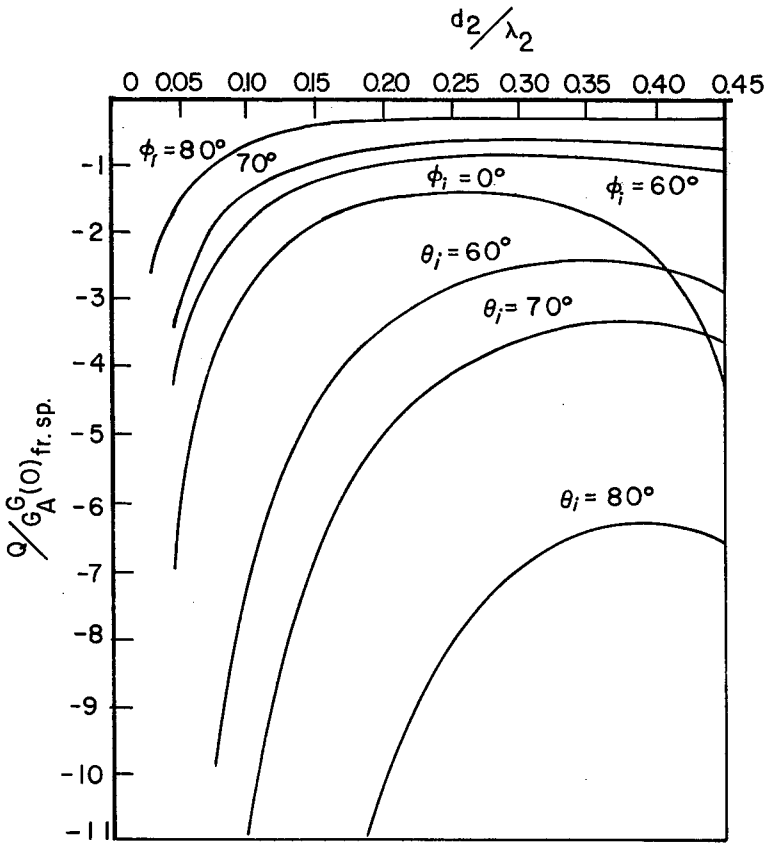
FIG. 17 is a family of curves showing the normalized coupling, Q, as a function of the electrical thickness of the middle dielectric material of the structure of the invention for various angles of incidence and a dielectric constant of 1.90.
Figure 16:
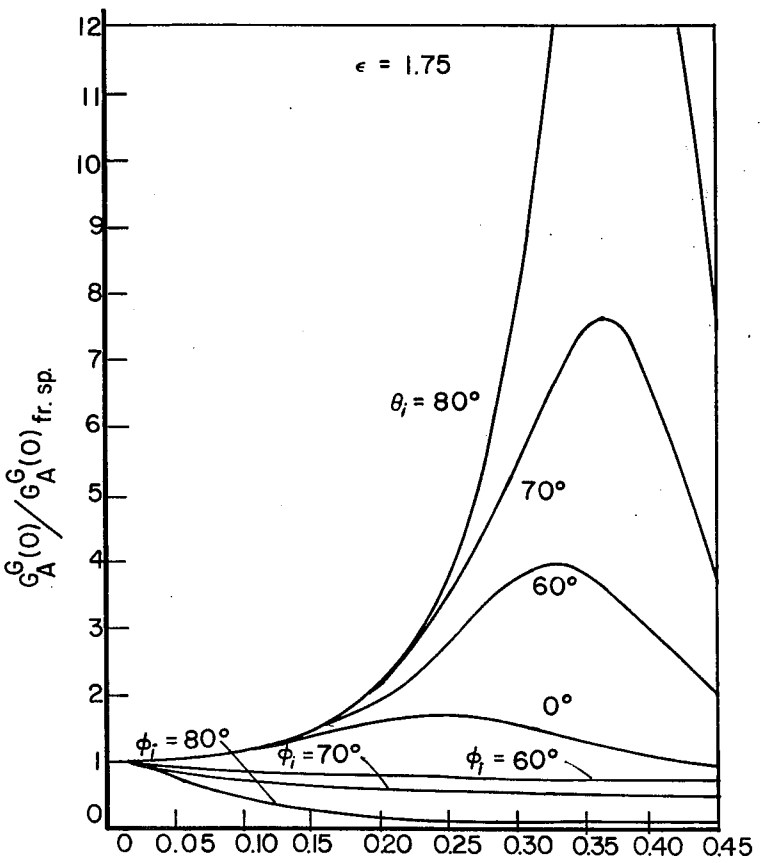
FIG. 16 shows a family of curves relating normalized conductance as a function of the electrical thickness of an outer dielectric strata for various angles of incidence for a given value (1.75) of dielectric constant.

Looking to FIGS. 16 and 17, correspondng measured transmission curves as a function of incidence for a broad range of angles of incidence ranging to 80° are revealed. In the figures, FIG. 16 represents transmission in the E-plane, while FIG. 17 represents corresponding H-plane prrformance. Procedures for carrying out the measurements generating curves 16 and 17 are described in the following publication:

IX. Luebbers, R. J., "Analysis of Various Periodic Slot Array Geometrics Using Modal Matching," Ph.D. Dissertation, 1975. The Ohio State University, Columbus, Ohio.

Since certain changes may be made in the above described apparatus without departing from the scope of the invention herein involved, it is intended that all matter contained in the description thereof or shown in the accompanying drawings shall be interpreted as illustrative and not in a limiting sense.

We claim:

1. A composite space filter for use in conjunction with electromagnetic radiation incident thereto over a range of angles of incidence comprising:

frequency bandwidth determinant means including at least one sheet configured to define a periodic array of recurrent filter components for deriving a predetermined frequency bandwidth performance; and first and last outwardly disposed strata of dielectric material respectively disposed in parallel adjacency at opposite surfaces of said frequency bandwidth determinant means, said first and last strata having respective thicknesses and equivalent dielectric constant configuration to exhibit a conductance transformation ratio which varies with said angle of incidence to effect a constant conductance through said frequency bandwidth determinant means over said range of angles of incidence.

2. The composite spacer filter of claim 1 in which said frequency bandwidth determinant means comprises at least two conductive sheets each configured to define a periodic array of slots and situated adjacent the opposed parallel surfaces of an intermediately disposed layer of dielectric material.

3. The composite space filter of claim 2 in which said layer of dielectric material has a thickness and dielectric constant for deriving a critical coupling between said adjacent periodic arrays of filter components.

4. The composite space filter of claim 1 in which said frequency bandwidth determinant means, combined with said first and last outwardly disposed strata exhibit a total thickness of value representing an odd multiple of slightly more than $\frac{1}{4}$ of a wavelength at the center of a selected frequency band of said radiation.

5. The composite space filter of claim 1 in which said first and last outwardly disposed strata have an effective relative dielectric constant of value between about 1.2 and 1.8.

6. The composite space filter of claim 2 in which said sheets are spaced apart in mutually parallel relationship and corresponding filter components of said arrays of each are arranged in mutually aligned relationship.

7. The composite space filter of claim 6 in which the mutually inwardly facing surfaces of said sheets are situated adjacent said intermediately disposed layer of dielectric material.

8. The composite space filter of claim 7, in which said layer of dielectric material has a thickness and dielectric constant for deriving a critical coupling between said adjacent periodic arrays of filter components.

9. The composite space filter of claim 8 in which said first and last strata are formed of dielectric material having the same dielectric constant.

10. The composite space filter of claim 9 in which said first and last strata are of the same electrical thickness.

11. The composite space filter of claim 10 in which said frequency bandwidth determinant means, combined with said first and last outwardly disposed strata exhibit a total thickness of value representing an odd multiple of slightly more than $\frac{1}{4}$ of a wavelength at the center of a selected frequency band of said radiation.

12. The composite space filter of claim 11 in which said first and last outwardly disposed strata have an effective relative dielectric constant of value between about 1.2 and 1.8.

13. A composite space filter for use in conjunction with electromagnetic radiation of wavelength at th center of a selected frequency band designated, $\gamma$, incident thereto over a range of angles of incidence, comprising:

at least two conductive surfaces each configured to define a periodic array of slots, said surfaces being spaced apart a distance, $d_1$;

means defining a dielectric medium positioned intermediate said surfaces and exhibiting an equivalent dielectric constant, $\epsilon_1$;

first and last strata of dielectric material disposed outwardly of and adjacent said conductive surfaces and respectively having thicknesses $d_2$ and $d_3$ and equivalent dielectric constant values of $\epsilon_2$ and $\epsilon_3$;

said distance, $d_1$, and dielectric constant $\epsilon_1$ providing a coupling, Q with each said array;

said distances $d_2$, $d_3$ and respective dielectric constants $\epsilon_2$, $\epsilon_3$ providing a conductance, $G_A{}^G(0)$ with respect to each said array; and $$\text{Transmission Coefficient} = 1 = \frac{1}{2}\left[\frac{G_A^G(0)}{Q} + \frac{Q}{G_A^G(0)}\right].$$

14. The composite space filter of claim 13 in which the value of distance, $d_1$, and constant $\epsilon_1$ are selected to derive a substantially critical coupling between said arrays of slots.

15. The composite space filter of claim 13 in which: $\sqrt{\epsilon_2 d_2} = \sqrt{\epsilon_3 d_3}$.

16. A multilayer space filter structure comprising:

a plurality of conductive sheets each configured having a periodic array of slots;

dielectric layers positioned intermediate adjacent pairs of said conductive sheets each having a thickness and exhibiting an equivalent dielectric constant for effecting coupling of said periodic arrays;

first and last dielectric strata respectively situated adjacent the outermost disposed ones of said conductive sheets and having respective thicknesses and effective dielectric constant configurations to exhibit a conductance transformation ratio which varies with respect to the angles of incidence of electromagnetic radiation incident upon said structure to effect a constant conductance through said conductive sheets over said range of angles of incidence.

17. The multilayer space filter of claim 16 which said dielectric layers positioned intermediate adjacent pairs of conductive sheets have thicknesses and dielectric constants for deriving a critical coupling between adjacent conductive sheets having periodic arrays of slots.

* * * * *